US008807209B2

(12) United States Patent
King

(10) Patent No.: US 8,807,209 B2
(45) Date of Patent: Aug. 19, 2014

(54) SWELLABLE MATERIAL AND METHOD

(75) Inventor: James G. King, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 602 days.

(21) Appl. No.: 12/728,882

(22) Filed: Mar. 22, 2010

(65) Prior Publication Data

US 2011/0101628 A1 May 5, 2011

Related U.S. Application Data

(62) Division of application No. 12/126,055, filed on May 23, 2008, now abandoned.

(60) Provisional application No. 60/991,546, filed on Nov. 30, 2007, provisional application No. 60/941,221, filed on May 31, 2007.

(51) Int. Cl.
*F16J 15/02* (2006.01)
*E21B 33/12* (2006.01)

(52) U.S. Cl.
CPC ..... *E21B 33/1208* (2013.01); *E21B 33/1216* (2013.01)
USPC ..... 166/118; 166/179; 166/387; 166/180; 166/384; 277/331; 277/333; 277/334; 277/605; 277/627

(58) Field of Classification Search
USPC ..... 166/118–203, 387; 277/331, 333, 334, 277/340, 605, 607, 626–627, 645, 934
See application file for complete search history.

(56) References Cited

U.S. PATENT DOCUMENTS

| | | | | |
|---|---|---|---|---|
| 3,289,762 | A | 12/1966 | Schell | |
| 3,385,367 | A * | 5/1968 | Kollsman | 166/191 |
| 4,421,167 | A | 12/1983 | Erbstoesser | |
| 4,423,109 | A | 12/1983 | Greenman et al. | |
| 4,531,583 | A | 7/1985 | Revett | |
| 4,919,989 | A * | 4/1990 | Colangelo | 428/66.4 |
| 5,327,962 | A | 7/1994 | Head | |
| 6,543,538 | B2 | 4/2003 | Tolman | |
| 6,755,249 | B2 | 6/2004 | Robison | |
| 7,143,832 | B2 | 12/2006 | Freyer | |
| 7,198,107 | B2 | 4/2007 | Maguire | |
| 7,264,049 | B2 | 9/2007 | Maguire | |
| 7,350,582 | B2 | 4/2008 | McKeachnie | |
| 7,387,158 | B2 | 6/2008 | Murray et al. | |
| 7,416,022 | B2 | 8/2008 | Maguire | |
| 7,422,060 | B2 | 9/2008 | Hammami | |

(Continued)

FOREIGN PATENT DOCUMENTS

| | | | |
|---|---|---|---|
| EP | 0461901 | 12/1991 | |
| GB | 2448298 A * | 10/2008 | E21B 43/08 |
| WO | 9404626 | 3/1994 | |

OTHER PUBLICATIONS

Baker Oil Tools Product Report; Repacker; Product Family No. H30187; Baker Hughes Incorporated; Jun. 2007; pp. 1-2.

(Continued)

*Primary Examiner* — James Sayre
(74) *Attorney, Agent, or Firm* — Cantor Colburn LLP

(57) ABSTRACT

A swellable material seal includes a quantity of swellable material disposed in a geometric configuration; and a plurality of openings in the material to enhance wettability thereof by a swelling fluid.

9 Claims, 11 Drawing Sheets

(56) References Cited

U.S. PATENT DOCUMENTS

| | | | | |
|---|---|---|---|---|
| 7,661,481 | B2 * | 2/2010 | Todd et al. | 166/387 |
| 7,931,092 | B2 * | 4/2011 | Olinger | 166/387 |
| 2005/0121203 | A1 | 6/2005 | Richard | |
| 2006/0207763 | A1 | 9/2006 | Hofman | |
| 2007/0107901 | A1 | 5/2007 | Maguire | |
| 2007/0227733 | A1 | 10/2007 | Vercaemer | |
| 2007/0295503 | A1 | 12/2007 | Maguire | |
| 2008/0110626 | A1 * | 5/2008 | Allison et al. | 166/288 |
| 2008/0149345 | A1 | 6/2008 | Marya | |
| 2008/0185158 | A1 * | 8/2008 | Chalker et al. | 166/387 |
| 2008/0190606 | A1 | 8/2008 | Maguire | |
| 2008/0290603 | A1 * | 11/2008 | Laflin | 277/334 |

OTHER PUBLICATIONS

International Search Report and Written Opinion; International Appln No. PCT/US2008/066073; Mailed on Sep. 23, 2008; International Search Report p. 1-5; Written Opinion p. 6-13.

Keshka, Ashraf, et al.; "Practical Uses of Swellable Packer Technology to Reduce Water Cut: Case Studies From the Middle East and Other Areas"; SPE108613; Offshore Europe 2007; Aberdeen, Scotland, UK; Sep. 4-7, 2007;10 Pgs.

Baylocq, Pascal, et al.; "Ball Sealer Diversion When Fracturing Long and Multiple Triassic Sand Intervals on Alwyn Field, North Sea"; SPE54740; 1999 SPE European Formation Damage Conference; The Hague, The Netherlands; May 31-Jun. 1, 1999; 10 Pgs.

Yakeley, T., et al.; "Swellable Packers for Well Fracturing and Stimulation"; SPE110621; 2007 SPE Annual Technical Conference and Exhibition; Anaheim, CA; Nov. 11-14, 2007; 7 Pgs.

Al-Mumen, Adib A., et al.; "Unique Solution for Fracture Isolation Resolves Breakthrough Challenges in Horizontal Slim Hole Well"; IADC/SPE114475; IADC/SPE Asia Pacific Drilling Technology Conference and Exhibition; Jakarta, Indonesia; Aug. 25-27, 2008; 4 Pgs.

* cited by examiner

SWELLABLE MATERIAL AND METHOD

CROSS REFERENCE TO RELATED APPLICATIONS

This application claims the benefit of an earlier filing date from U.S. Provisional Application Ser. No. 60/991,546, filed Nov. 30, 2007; also from U.S. Provisional Application Ser. No. 60/941,221, filed May 31, 2007, and from U.S. Non Provisional Application Ser. No. 12/126,055, filed May 23, 2008, the entire contents of each of which is incorporated herein by reference.

BACKGROUND

Swellable materials have been used to assist in setting seals or as seals themselves in various industries. Such materials are capable of generating a contact force against a nearby a structure which is capable of either of the noted uses of setting or sealing, or in some cases both, when exposed to a swelling fluid reactive with the swelling material.

Swelling can occur through absorption or chemical reaction. In applications where a higher degree of swelling, for either purpose is needed, difficulty has been experienced as sufficient volumetric change has not been reliably achievable and in addition when higher volumetric change is attempted, the material itself loses physical integrity thus compromising the ultimate goal of the application.

SUMMARY

A swellable material seal includes a quantity of swellable material disposed in a geometric configuration; and a plurality of openings in the material to enhance wettability thereof by a swelling fluid.

BRIEF DESCRIPTION OF THE DRAWINGS

Referring now to the drawings wherein like elements are numbered alike in the several Figures.

DETAILED DESCRIPTION

Figure 1:
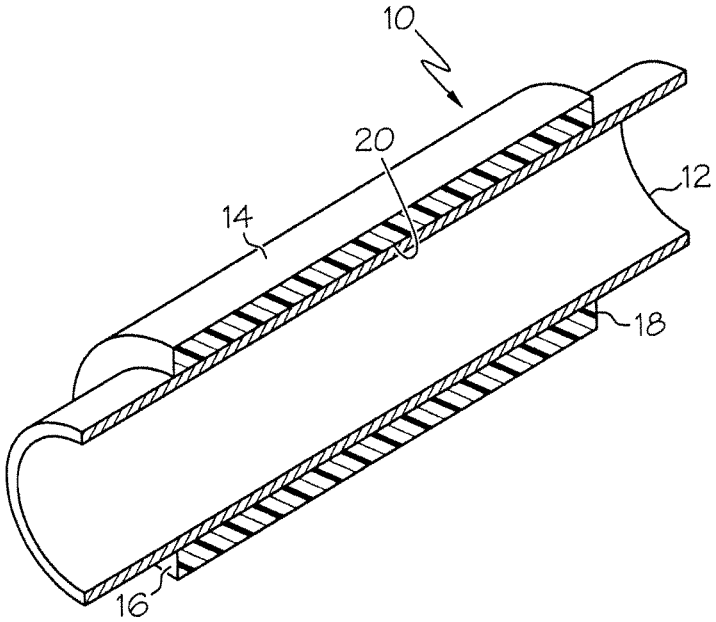
FIG. 1 (PRIOR ART)
FIG. 1 is a schematic perspective cross-sectional representation of a prior art swellable seal.

Referring to FIG. 1 (prior art), one of the problems associated with higher volumetric expansions of swellable materials is that the material itself when configured for use as an element such as an annular seal 10 for example, is bonded or otherwise mounted to a mandrel 12, generally in a way that reduces access of swelling fluid to the swellable material. In other words, the surfaces of an exemplary annular seal that are contactable by swelling fluid are an outside dimension surface 14 of the seal and end surfaces 16 and 18 at the axial ends of the seal. An inside dimension surface 20 of the seal is relatively protected from contact with swelling fluid applied to the annular seal 10. This is due to whatever means has been used to mount the annular seal to the mandrel. Resultantly, the exposed surfaces of the swellable material 14, 16, 18 must expand more significantly to achieve contact with an opposing structure (not shown) than they would have to have done if a greater proportion of the swellable material were "wettable" by the swelling fluid. More specifically, swelling would occur to a greater extent and more evenly if a greater percentage of the original volume of the material could be affected by the swelling fluid. Greater distribution of the swelling fluid throughout the volume of the swellable material increases the potential contact pressure generatable by the swellable material, and reduces spongyness of the swelled swellable material. Such sponginess can often be experienced when a greater expansion of some parts of the swellable material than others makes up for the lack of swelling in those other parts of the swellable material. A swellable material as contemplated herein may be an elastomeric material such as rubber, for example, swelling EPDM, swelling Nitrile, etc.

In accordance with the teachings hereof, fibrous material is embedded in the swellable material. This has two desirable effects. 1) The fibrous material provides a fluid pathway facilitating movement of the swelling fluid into an interior volume of the swellable material, thereby wetting areas of the volume otherwise insulated from the swelling fluid and, 2) the fibrous material lends mechanical strength to the swellable material, especially after swelling. Fibrous materials contemplated for use herein include but are not limited Kevlar fiber, cotton fiber, etc. each of which have at least one of wicking properties and absorptive properties of for example water or oil. Other fibrous materials include but are not limited to hollow fiber, bicomponent fiber, etc. and act as capillary tubes resulting in swelling fluid transmission to otherwise insulated portions of the swellable material. Such tubes may be long or short or both and may also be used simply as conveyors that move fluid from one end to the other end, or may also be permeable along their respective lengths so that they supply swelling fluid along their lengths to the swellable material. Each of the exemplary fibrous materials listed above also exhibits mechanical properties that enhance the strength of a swellable material into which they are embedded. Increasing the mechanical strength of the swellable material is desirable to improve extrusion resistance, among other things.

Figure 2:
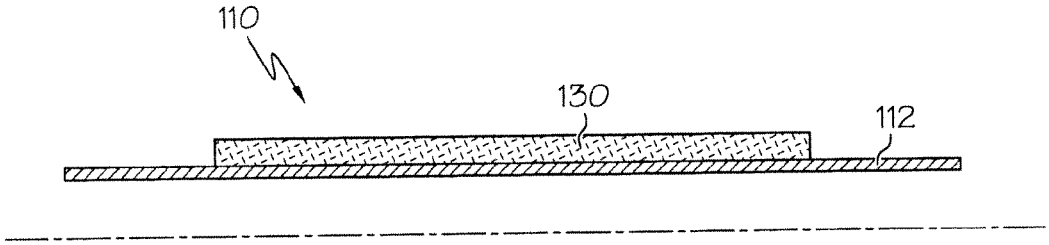
FIG. 2 is a schematic cross-sectional view of one embodiment of an improved swelling seal as described herein.
Figure 2A:
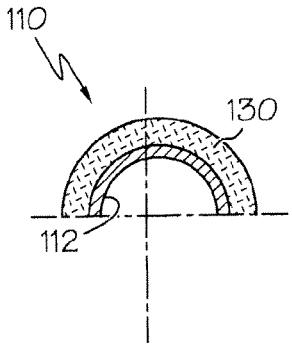
FIG. 2*a* is a cross-sectional view of the embodiment of FIG. 2 taken along section line 2*a*-2*a;*

Referring to FIGS. 2 and 2*a*, a first embodiment of the improved swellable material is illustrated in the form of an annular seal 110 mounted at an outside diameter of a mandrel 112. Fibrous material 130 is visible in the cross section of the seal 110. As will be evidenced from the drawing, the embodiment utilizes a random distribution of fibrous material 130 within the seal 110. The fibrous material and swellable material of the seal 110 may be completely homogenously mixed or may be less so depending upon the desired level of homogeneity of swelling of the swellable material of the seal 110. The fibrous material 130 may be of short fibers, long fibers or both as desired and may be mixed with the swellable material at a time prior to that material becoming relatively non-mixable in form. Stated alternately, the fibrous material 130 is mixed with the swellable material at a point in processing of the swellable material when mixing is possible and in one embodiment easiest to accomplish. The fibrous material 130 acts to wick the swelling fluid into the volume of the swellable material to enhance the wettability of the swellable material and therefore the degree of swelling of the material.

Figure 3:
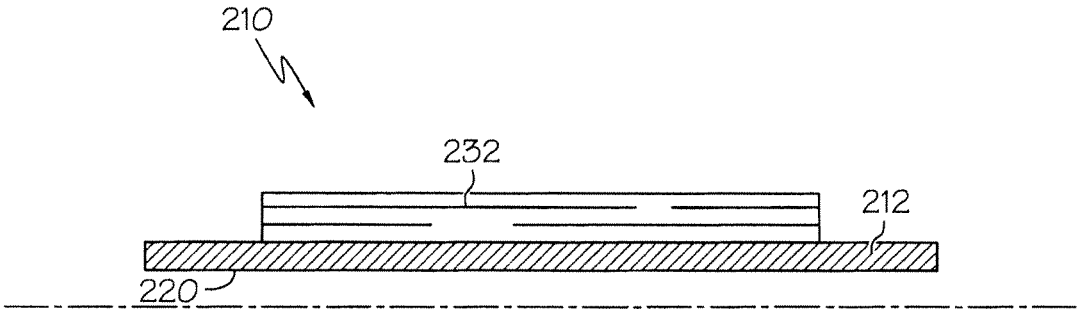
FIG. 3 is a schematic cross-sectional view of a second embodiment of an improved swelling seal as described herein.
Figure 3A:
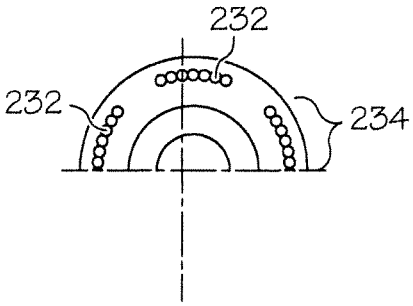
FIG. 3*a* is a cross-sectional view of the embodiment of FIG. 3 taken along section line 3*a*-3*a;*

Referring to FIGS. 3 and 3*a*, another embodiment of the improved swellable material is illustrated in the form of an annular seal 210 mounted at an outside dimension of a mandrel 212. Fibrous material 230 is visible in the cross section of the seal 210. It will be appreciated from the drawing FIGS. 3 and 3*a* that the distribution pattern of fibrous material 230 in the swellable material of seal 210 is in a layered format. The layered format comprises individual fibers 232 laid axially of the element, and in one alternative embodiment comprises fibers grouped with a number of other individual fibers laid side-by-side and axially of the seal 210 as a pad 234. The layout for this embodiment is best viewed in FIG. 3*a* where it is apparent that various groups of fibers are laid at differing radial distances from the inside dimension 220 of seal 210.

Figure 4:
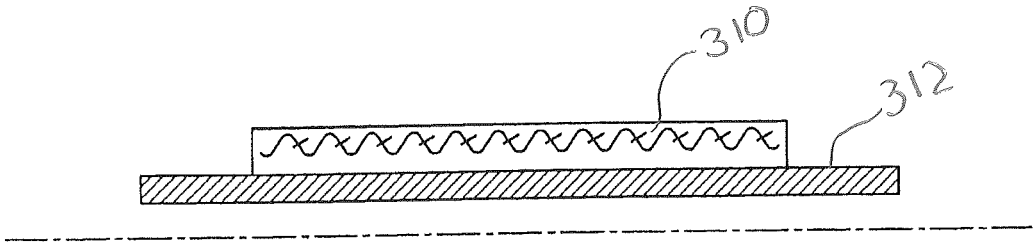
FIG. 4 is a schematic cross-sectional view of a third embodiment of an improved swelling seal as described herein.
Figure 4A:
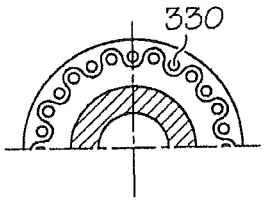
FIG. 4*a* is a cross-sectional view of the third embodiment of FIG. 4 taken along section line 4*a*-4*a;*
Figure 4B:
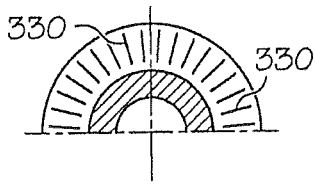
FIGS. 4*b*-4*f* are cross-sectional end views of the embodiment of FIG. 4 illustrating alternate layouts for the fabric bits.
Figure 4C:
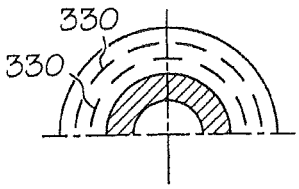
Figure 4D:
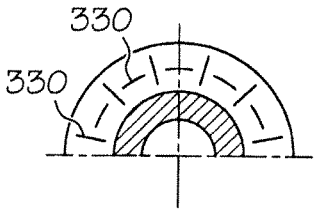
Figure 4E:
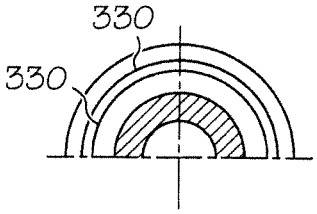
Figure 4F:
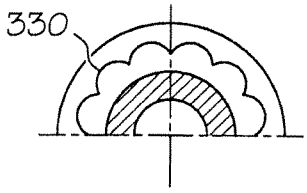
Figure 5:
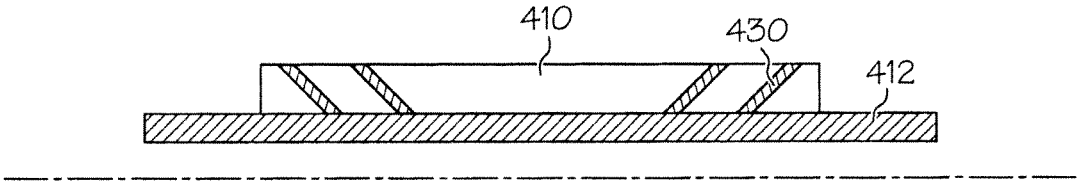
FIG. 5 is a schematic cross-sectional view of a fourth embodiment of an improved swelling seal as described herein.
Figure 5A:
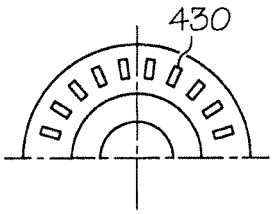
FIG. 5*a* is a cross-sectional view of the fourth embodiment of FIG. 5 taken along section line 5*a*-5*a;*
Figure 6:
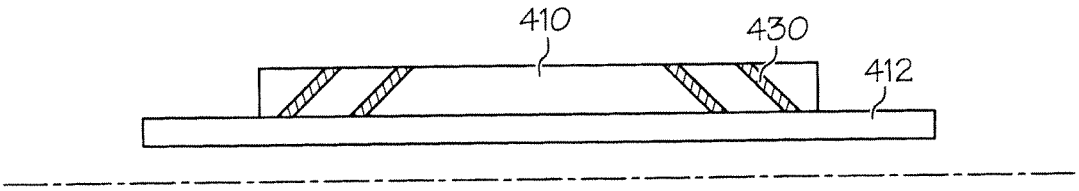
FIG. 6 is a schematic cross-sectional view of a fifth embodiment of an improved swelling seal as described herein.
Figure 6A:
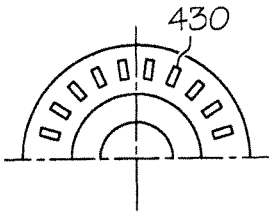
FIG. 6*a* is a cross-sectional view of the fifth embodiment of FIG. 6 taken along section line 6*a*-6*a;*

Referring to FIGS. 4 and 4*a*, a third embodiment of the improved material, illustrated in the form of an annular seal 310, is mounted at an outside dimension of a mandrel 312. Fibrous material 330 is visible in the cross section of seal 310 in FIG. 3. In this embodiment, the fibrous material is arranged as a woven or non woven fabric. Each bit of fabric embedded in the swellable material is about 0.25 $in^2$ or more. The bits are embedded in a number of possible patterns some examples of which are illustrated in FIGS. 4*b*, 4*c*, 4*d*, 4*e* and 4*f*.

Referring to FIGS. 5 and 5*a* and 6 and 6*a*, another embodiment of the improved swellable material is illustrated in the form of an annular seal 410 mounted at an outside dimension of a mandrel 412. Fibrous material 430 is visible in the cross section of the seal 410. It will be appreciated from the drawing FIGS. 5 and 5*a* that the distribution pattern of fibrous material 430 in the swellable material of seal 410 is in a layered format. In this embodiment the distribution of a fibrous material is a woven or non woven fabric arranged frustoconically through the swellable material seal 410. This is best viewed in FIG. 5. It will be appreciated that one or more frustocones of fabric may be employed and that they may be arranged such that the frustocone angles outwardly as radial dimension from an axis of the element grows or angles inwardly as radial dimension from an axis of the element grows as in FIG. 5 or FIG. 6, respectively, or in any combination of FIGS. 5 and 6.

Figure 7:
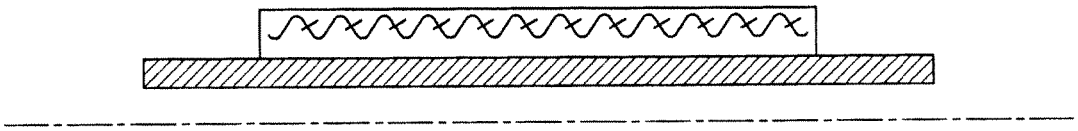
FIG. 7 is a schematic cross-sectional view of a sixth embodiment of an improved swelling seal as described herein.
Figure 7A:
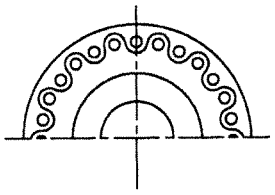
FIG. 7*a* is a cross-sectional view of the sixth embodiment of FIG. 7 taken along section line 7*a*-7*a;*

Referring now to FIG. 7 another embodiment is illustrated very similar to the embodiment of FIG. 4 but utilizing corrugated fabric instead of planar fabric.

Figure 8:
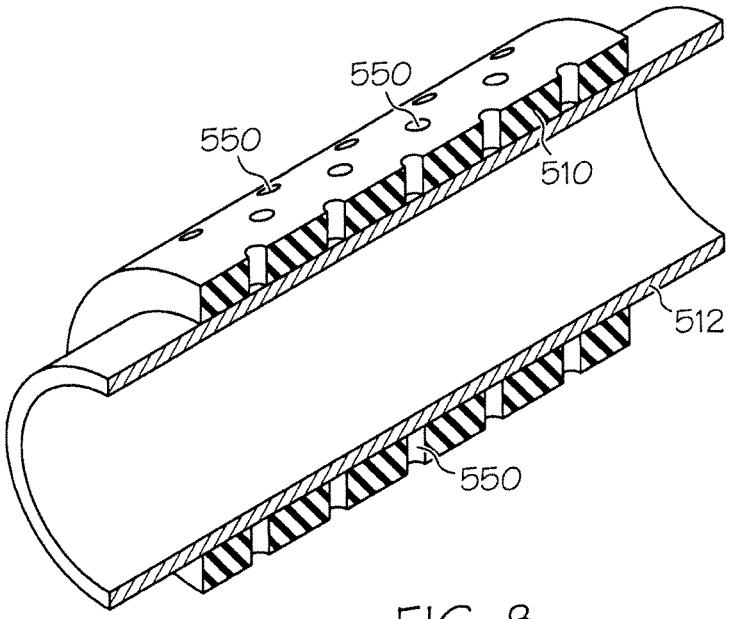
FIG. 8 is a perspective cross-sectional schematic view of a seventh embodiment disclosed herein.

In another embodiment, referring to FIG. 8, the swellable annular seal material 510, disposed upon mandrel 512 is configured to have a number of openings 550 therein. The openings may be radially directed as shown or may have different angularity if desired or if useful for a particular application. The openings 550 may be of any desired depth, including completely through the swellable material 510, and the greater the depth the greater the wettability of the swellable material. In one embodiment and as shown, the openings 550 are in a grid pattern. It is further noted that the density of the openings 550 may be greater or less than what is shown in FIG. 8.

Figure 9:
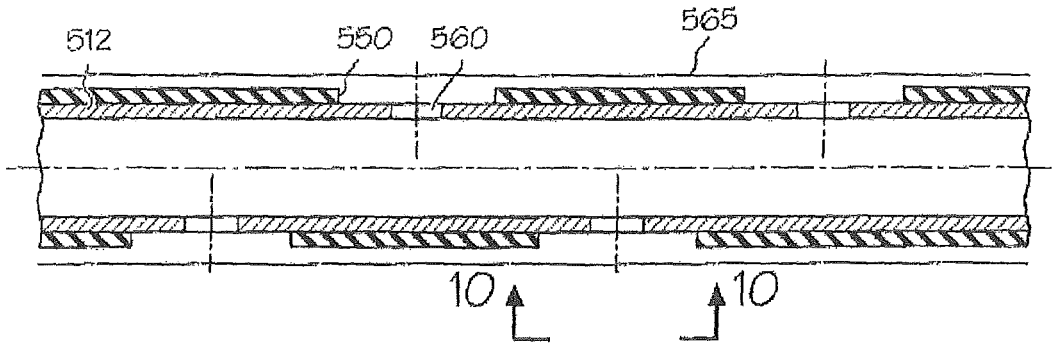
FIG. 9 is a cross sectional schematic view of an eighth embodiment related to that of FIG. 8.
Figure 10:
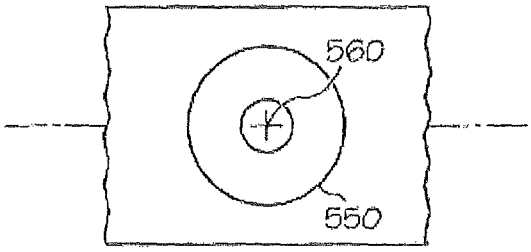
FIG. 10 is a plan view of a portion of FIG. 9 as indicated by view line 10-10.

Referring to FIGS. 9 and 10, a related embodiment to that of FIG. 8 is illustrated. In the embodiment of FIG. 9, not only do the openings 550 extend to the surface of the mandrel 512, but in addition, they are aligned with openings 560 in the mandrel itself. Where the openings 550 are aligned with openings 560, the openings 550 can be used as swellable material conduits once the swellable material has been swelled into contact with another structure 565. For example, where openings 550 are aligned with openings 560 and the another structure 565 is the borehole wall, an isolated swellable material conduit directly from the mandrel to the borehole wall can be created upon swelling of the swellable material. When used in conjunction with a flow isolation configuration in the mandrel itself, operations such as fracing, stimulation, or any other operation where fluid is applied from the mandrel to another structure can be undertaken in a specific area while maintaining isolation from any other area radially outwardly of the mandrel. Such a configuration of the swellable material and the underlying mandrel opening 560 can be obtained by punching an opening in the swellable material either before or after applying the swellable material to the mandrel and then drilling the opening 560 through the mandrel in register with the opening 550. It is also possible to simply apply the swellable material opening 550 over an existing opening 560 in the mandrel 512. Further, it is pointed out that although the embodiment is illustrated with the openings 550 extending completely through the swellable material, there are applications where it is desirable to extend the openings to close to the surface of the mandrel 512 but to not actually reach it. In such configuration the openings 560 will be sealed until a desired time when an appropriate diverter device allows pressure from a fluid to act on the swellable material from within the mandrel 512 and rupture the relatively thin material left in place over the opening 560.

Figure 11:
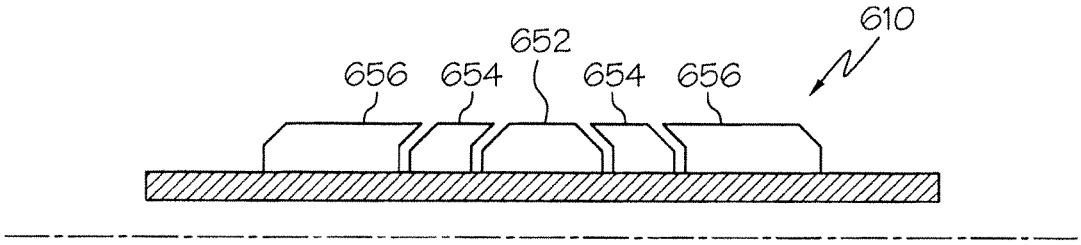
FIG. 11 is a cross-sectional view of an ninth embodiment disclosed herein.

In yet another embodiment, referring to FIG. 11, a configuration of individual components of swellable seal material 610 is illustrated. This embodiment combines the concept of primary sealing structures and backup rings with swellable material construction and additionally with an understanding of exposed surface area of the swellable material. As has been clearly indicated hereinabove, causing the swellable material to be wettable improves the swelling characteristics thereof. Increasing the wettable surface area to volume ratio certainly increases the wettability. In this embodiment, the seal 610 is segmented into a primary seal 652, and set of cups 654 and a set of backups 656. The configuration of the segments causes the primary seal to remain sealed similarly to packers that use backups for the same reason but in this case, it has been discovered that swellable material in segment begets an advantage if so configured. Swellable material alone could be employed or any of the improved swellable materials disclosed hereinabove could be employed in the configuration of FIG. 11.

Figure 12:
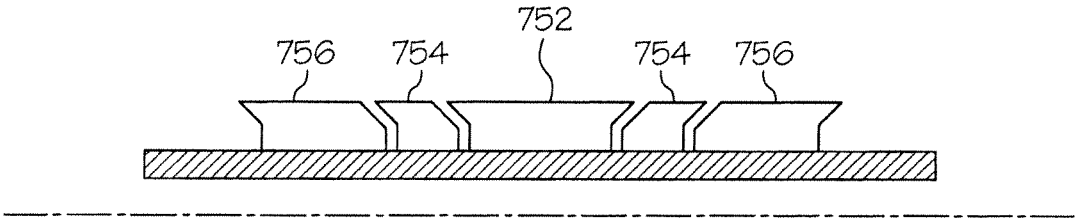
FIG. 12 is a cross-sectional view of a tenth embodiment disclosed herein.

Finally, FIG. 12 is a reversed configuration of the concept of FIG. 11 where the center piece 752 acts as the backup, 754 are the cups and 756 are additional backups.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A swellable material seal comprising:

a unitary quantity of swellable material disposed in a geometric configuration; and one or more openings in the material to enhance wettability thereof by a swelling fluid, the one or more openings extending from a mandrel upon which the seal is mounted to a surface of the seal configured to interact with a radially disposed separate structure upon deployment of the seal, the openings then creating fluid conduits between the mandrel and the separate structure, wherein the openings are configured such that there is no contact between portions of the swellable material opposingly disposed about and defining the one or more openings.

2. The swellable material seal as claimed in claim 1 wherein the plurality of openings are arranged in a pattern.

3. The swellable material seal as claimed in claim 1 wherein at least one of the plurality of openings is cylindrical.

4. The swellable material seal as claimed in claim 1 wherein the quantity of material is cylindrical.

5. The swellable material seal as claimed in claim 1 wherein the one or more openings are aligned with one or more openings in the mandrel.

6. The swellable material seal as claimed in claim 1 wherein the one or more openings are radially arranged.

7. The swellable material seal as claimed in claim 1 wherein the one or more openings are angularly arranged.

8. A swellable material seal comprising:

a unitary quantity of swellable material disposed in a geometric configuration; and one or more openings in the material to enhance wettability thereof by a swelling fluid, the one or more openings extending from a mandrel upon which the seal is mounted to a surface of the seal configured to interact with a radially disposed separate structure upon deployment of the seal, the openings then creating fluid conduits between the mandrel and the separate structure, wherein the one or more openings are aligned with one or more openings in the mandrel.

9. A swellable material seal comprising:

a unitary quantity of swellable material disposed in a geometric configuration; and one or more openings in the material to enhance wettability thereof by a swelling fluid, the one or more openings extending from a mandrel upon which the seal is mounted to a surface of the seal configured to interact with a radially disposed separate structure upon deployment of the seal, the openings then creating fluid conduits between the mandrel and the separate structure, wherein the one or more openings are angularly arranged.

* * * * *